US012102879B2

(12) United States Patent
Denton et al.

(10) Patent No.: US 12,102,879 B2
(45) **Date of Patent: *Oct. 1, 2024**

(54) USER-PACED EXERCISE EQUIPMENT

(71) Applicant: Board of Regents of the University of Nebraska, Lincoln, NE (US)

(72) Inventors: William Denton, Omaha, NE (US); Molly Schieber, Omaha, NE (US); Casey Wiens, Omaha, NE (US)

(73) Assignee: Board of Regents of the University of Nebraska, Lincoln, NE (US)

( * ) Notice: Subject to any disclaimer, the term of this patent is extended or adjusted under 35 U.S.C. 154(b) by 350 days.

This patent is subject to a terminal disclaimer.

(21) Appl. No.: 17/533,837

(22) Filed: Nov. 23, 2021

(65) Prior Publication Data

US 2022/0152457 A1 May 19, 2022

Related U.S. Application Data

(63) Continuation of application No. 16/341,365, filed as application No. PCT/US2017/057050 on Oct. 17, 2017, now Pat. No. 11,185,740.

(Continued)

(51) Int. Cl.
*A63B 24/00* (2006.01)
*A63B 21/00* (2006.01)

(Continued)

(52) U.S. Cl.
CPC .... *A63B 24/0087* (2013.01); *A63B 21/00076* (2013.01); *A63B 22/025* (2015.10);

(Continued)

(58) Field of Classification Search
CPC ..... A63B 24/0087; A63B 2024/0093; A63B 2220/836; A63B 22/0242–025;

(Continued)

(56) References Cited

U.S. PATENT DOCUMENTS 7,220,219 B2 5/2007 Papadopoulos et al.
8,480,541 B1 * 7/2013 Brunts ..... A63B 22/025 482/7

(Continued)

FOREIGN PATENT DOCUMENTS

EP 1145682 A2 10/2001
EP 2060229 B1 6/2011

OTHER PUBLICATIONS

International Search Report and Written Opinion issued in PCT Application No. PCT/2017/057050 dated Jan. 26, 2018; 13 pages.

(Continued)

*Primary Examiner* — Joshua Lee
(74) *Attorney, Agent, or Firm* — Nasr Patent Law LLC; Faisal K. Abou-Nasr

(57) ABSTRACT

Disclosed herein are examples of user-paced exercise equipment, as well as related circuitry, methods, and computer-readable media. For example, disclosed herein is a user-paced treadmill, including a belt, a motor coupled to the belt, and control circuitry communicatively coupled to the motor. The control circuitry may be configured to change a velocity of the belt based at least in part on a body velocity and a leg swing velocity of a user of the user-paced treadmill.

19 Claims, 8 Drawing Sheets

Related U.S. Application Data

(60) Provisional application No. 62/410,116, filed on Oct. 19, 2016.

(51) Int. Cl.
*A63B 22/02* (2006.01)
*A63B 22/04* (2006.01)
*A63B 71/06* (2006.01)

(52) U.S. Cl.
CPC ..... *A63B 24/0062* (2013.01); *A63B 22/04* (2013.01); *A63B 2024/0065* (2013.01); *A63B 2024/0093* (2013.01); *A63B 71/0622* (2013.01); *A63B 2220/05* (2013.01); *A63B 2220/10* (2013.01); *A63B 2220/22* (2013.01); *A63B 2220/30* (2013.01); *A63B 2220/40* (2013.01); *A63B 2220/56* (2013.01); *A63B 2220/62* (2013.01); *A63B 2220/806* (2013.01); *A63B 2220/836* (2013.01); *A63B 2225/50* (2013.01); *A63B 2230/00* (2013.01); *A63B 2230/04* (2013.01)

(58) Field of Classification Search
CPC ..... A63B 21/00076; A63B 22/04; A63B 22/0062; A63B 22/0087; A63B 71/0622; A63B 2024/0065; A63B 2220/05; A63B 2220/10; A63B 2220/22; A63B 2220/30; A63B 2220/40; A63B 2220/56; A63B 2220/62; A63B 2220/806; A63B 2225/50; A63B 2230/00; A63B 2230/04
See application file for complete search history.

(56) References Cited

U.S. PATENT DOCUMENTS

| | | | | |
|---|---|---|---|---|
| 8,979,710 | B2 * | 3/2015 | McCready | G06F 3/011 482/8 |
| 9,414,784 | B1 * | 8/2016 | Berme | A61B 5/01 |
| 9,622,686 | B1 * | 4/2017 | Berme | A63B 69/0053 |
| 2009/0036272 | A1 | 2/2009 | Yoo | |
| 2009/0197743 | A1 | 8/2009 | Schmidt | |
| 2009/0215588 | A1 | 8/2009 | Riener et al. | |
| 2013/0178958 | A1 | 7/2013 | Kulach et al. | |
| 2013/0225369 | A1 * | 8/2013 | Fisbein | A63B 71/0622 482/1 |
| 2013/0274063 | A1 * | 10/2013 | Tyger | A63B 23/04 482/54 |
| 2014/0274567 | A1 * | 9/2014 | McCready | A63B 71/0622 482/8 |
| 2016/0023049 | A1 | 1/2016 | Dalebout | |

OTHER PUBLICATIONS

Wikipedia, "Communications Specification for Fitness Equipment," retrieved from https://en.wikipedia.org/wiki/Communications_Specification_for_Fitness_Equipment on Sep. 24, 2017; 3 pages.

* cited by examiner

USER-PACED EXERCISE EQUIPMENT

CROSS-REFERENCE TO RELATED APPLICATION

This application is a continuation of U.S. Nonprovisional application Ser. No. 16/341,365 (U.S. Pat. No. 11,185,740), filed on Apr. 11, 2019 and titled "USER-PACED EXERCISE EQUIPMENT," which is national stage application under 35 U.S.C. § 371 of International App. No. PCT/US2017/057050, filed on Oct. 17, 2017 and titled "USER-PACED EXERCISE EQUIPMENT," which claims priority to U.S. Provisional App. No. 62/410,116, filed Oct. 19, 2016 and titled "METHOD AND SYSTEM FOR A SELF-PACING TREADMILL." Each of the priority applications is incorporated in its entirety by reference herein.

BACKGROUND

The speed and other operational parameters of a conventional piece of exercise equipment, such as a conventional treadmill, are typically manually set by the user. If the user wishes to change any of these parameters during operation, the user manipulates a keypad or other touch interface to make the change.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, not by way of limitation, in the figures of the accompanying drawings.

DETAILED DESCRIPTION

Figure 2:
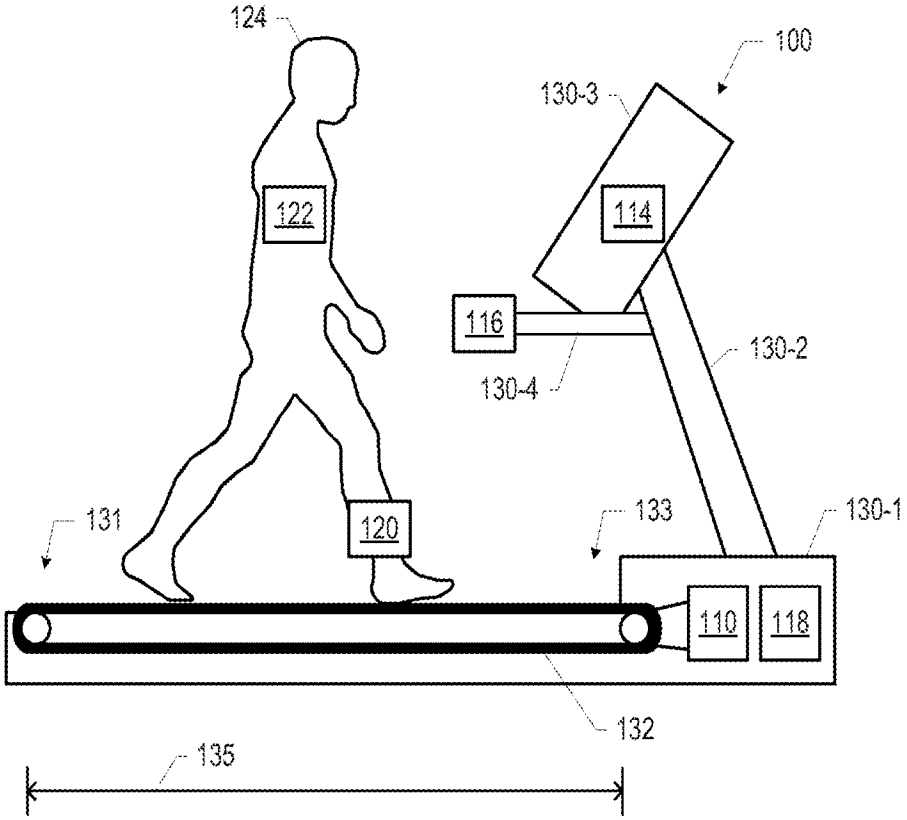
FIG. 2 illustrates example locations for various circuitry in user-paced exercise equipment, in accordance with various embodiments.

Disclosed herein are examples of user-paced exercise equipment, as well as related circuitry, methods, and computer-readable media. For example, disclosed herein is a user-paced treadmill, including a belt, a motor coupled to the belt, and control circuitry communicatively coupled to the motor. The control circuitry may be configured to change a velocity of the belt based at least in part on a body velocity and a leg swing velocity of a user of the user-paced treadmill.

Exercise equipment, such as treadmills, stair climbing machines, and Jacob's ladder machines, may be used in rehabilitation, training, and other settings. However, the motion of a user using this equipment may not necessarily be the same as the motion of the user in the analogous natural environment. For example, the gait dynamics of a person walking on the treadmill may be different from the gait dynamics of that person walking on the ground; a person walking on a fixed speed treadmill may minimize stride-to-stride fluctuations in walking speed, while a person walking on the ground may exhibit more variability in stride time, stride length, and stride speed. These differences may be the result of the constraints imposed by the exercise equipment that are not present in the natural environment. For example, the motion of a user on a treadmill may be influenced by the fixed speed of the treadmill, and as a result, may deviate from more "natural" walking motion. Using conventional exercise equipment, therefore, may not realistically prepare a user for performing analogous motions in the natural setting, and thus the effectiveness of using conventional exercise equipment for rehabilitation and/or training may be limited.

Disclosed herein are systems and techniques that may automatically adjust the velocity of a piece of exercise equipment to match the varying speed of the user of that equipment. Exercise equipment employing such systems and techniques may more effectively mimic the natural environment (e.g., allowing a user to achieve more variability in stride time, stride length, and/or stride speed), and thus may be more effective at rehabilitation and/or training than conventional equipment. Some previous attempts to develop user-paced exercise equipment have required the use of force plates or rods to measure the forces that a user exerts on the equipment; various ones of the embodiments disclosed herein do not require such force plates or rods. Other previous attempts to develop user-paced exercise equipment have focused solely on keeping a user in the center of the position range of the equipment, causing the user to artificially oscillate around this location; various ones of the embodiments disclosed herein allow the user to freely move at any position in the range.

In the following detailed description, reference is made to the accompanying drawings that form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order from the described embodiment. Various additional operations may be performed, and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C). The drawings are not necessarily to scale.

The description uses the phrases "in an embodiment" or "in embodiments," which may each refer to one or more of the same or different embodiments. Furthermore, the terms "comprising," "including," "having," and the like, as used with respect to embodiments of the present disclosure, are synonymous. As used herein, the term "velocity" may be a vector or scalar measurement; thus, in some embodiments, the terms "velocity" and "speed" may be interchangeable. As used herein, the term "exercise equipment" is intended to cover equipment that assists with physical motion of a user for any purpose, such as strength training, cardiovascular training, sports conditioning, rehabilitation, other medical uses, or any other related purpose.

Figure 1:
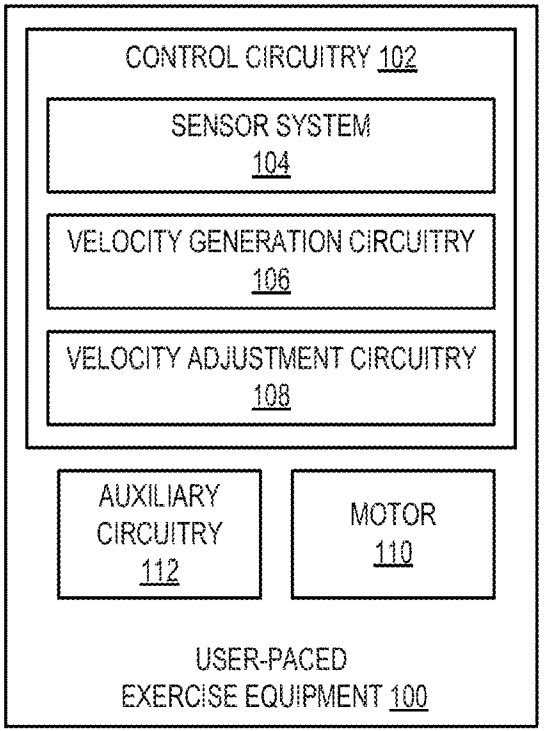
FIG. 1 is a block diagram of example user-paced exercise equipment, in accordance with various embodiments.

FIG. 1 is a block diagram of example user-paced exercise equipment 100, in accordance with various embodiments. For ease of exposition, the user-paced exercise equipment 100 may be referred to herein as the "equipment 100." The equipment 100 may be any suitable type of exercise equipment, such as a treadmill, a stair climbing machine, or a Jacob's ladder machine.

The equipment 100 may include control circuitry 102, auxiliary circuitry 112, and a motor 110. The control circuitry 102 may generate control signals for operation of the motor 110 and provide the control signals to the auxiliary circuitry 112, which may in turn provide electrical signals to the motor 110 to control the operation of the motor 110 in accordance with the control signals. In some embodiments, no auxiliary circuitry 112 may be included in the equipment 100, and instead, the control circuitry 102 may directly control the motor 110 (e.g., may directly provide electrical signals to the motor 110). The motor 110 may include a power supply, transformer, or other suitable components for providing power to the motor 110 to actuate the motor 110.

The control circuitry 102 may include a sensor system 104, velocity generation circuitry 106, and velocity adjustment circuitry 108. Although these elements are illustrated separately in FIG. 1, the underlying hardware of these elements may be shared in whole or in part between different ones of these elements. For example, the velocity generation circuitry 106 and the velocity adjustment circuitry 108 may share one or more processing devices and/or one or more memory devices (e.g., in accordance with any of the embodiments discussed below with reference to FIG. 13).

The sensor system 104 may, during operation of the equipment 100, generate data representative of the motion of one or more portions of the body of a user of the equipment 100. For example, FIG. 2 illustrates a user 124 walking or running on a belt 132 of a treadmill (the equipment 100); the sensor system 104 may generate data representative of the position, velocity, and/or acceleration of one or more portions of the body of the user 124. As used herein, the phrase "data representative of" a parameter may refer to data that specifically includes the value of the parameter or data that allows the parameter to be determined. The sensor system 104 may include any suitable number and arrangement of sensors to measure the desired motion variables. In some embodiments, the sensor system 104 may include one or more sensors positioned on the body of the user 124 (e.g., secured to or integrated with a chest strap as part of the circuitry 122 of FIG. 2, a bracelet or watch, a necklace, an ankle or a leg band as part of the circuitry 120 of FIG. 2, a shoe, etc.) and/or one or more sensors positioned in or on the equipment 100 (e.g., included in one or more of the housings 130 of FIG. 2, such as the lower housing 130-1, the support housing 130-2, the upper housing 130-3, or the arm housing 130-4; or attached to an outside surface of one of the housings 130, such as the circuitry 116 attached to an outer surface of the arm housing 130-4).

The sensor system 104 may include components that communicate wirelessly and/or via wires. For example, the sensor system 104 may include a wireless sensor (e.g., a wireless accelerometer) that communicates acceleration data to a complementary receiver included in the sensor system 104 (or included in the velocity generation circuitry 106, discussed further below).

In some embodiments, the sensor system 104 may include one or more distance sensors positioned in, on, or near the equipment 100 and oriented to measure the distance between a portion of the body of the user 124 and a reference point (e.g., the position of the distance sensor or another predetermined location). Such distance data may be processed (e.g., by differentiation) to generate velocity and/or acceleration data. Examples of distance sensors that may be included in the sensor system 104 include ultrasonic distance sensors, radar sensors, infrared (IR) distance sensors, laser range finders, image sensors (e.g., cameras and supporting circuitry that capture the relative position of the user 124 and one or more reference points on the equipment 100 using stereovision, motion capture technology, or other image processing techniques), or other types of distance sensors. In embodiments in which the distance sensors include image sensors, the user 124 may be outfitted with reflective markers (or other types of markers) that are readily identified by the image processing techniques so as to determine the distances (or other parameters) of interest.

In some embodiments, the sensor system 104 may include one or more accelerometers positioned on the user 124 and oriented to measure acceleration of a portion of the body of the user 124. For example, an accelerometer may be secured to or integrated with a chest strap (as part of the circuitry 122 of FIG. 2), a bracelet or watch, a necklace, an ankle or a leg band (as part of the circuitry 120 of FIG. 2), a shoe, or secured (e.g., removably) to any other portion of the body of the user 124 using any other suitable apparatus. Acceleration data may be processed (e.g., by integration) to generate velocity and/or distance data. Examples of accelerometers that may be included in the sensor system 104 may include single-axis accelerometers, multi-axis accelerometers, piezoelectric accelerometers, strain gauge accelerometers, or other types of accelerometers.

In some embodiments, the sensor system 104 may, during operation of the equipment 100, generate data representative of a position of the user 124 relative to the equipment 100. As used herein, the "position" of a user 124 may refer to any suitable measurement the represents the approximate location of the center of mass or other reference point on the body of the user 124. For example, in some embodiments, the position of the user 124 (also referred to herein as the "body position") may be measured at the sacrum, chest, or torso of the user 124. In some embodiments, the body position of a user 124 may be a relative measurement (e.g., "one meter from the arm of the treadmill") or a measurement in a more "global" coordinate system that includes the equipment 100.

In some embodiments, the sensor system 104 may, during operation of the equipment 100, generate data representative of the body velocity of the user 124. As used herein, "body velocity" may refer to any suitable measurement that represents the approximate speed of motion of the center of mass of the user 124. For example, in some embodiments, the body velocity of the user 124 may be measured at the sacrum of the user 124. In various embodiments, the body velocity may be a vector or scalar measurement. In some embodiments, the body velocity of the user 124 may be determined by differentiating data representative of a distance between a location on the torso or head of the user 124 and a reference location (e.g., a location on the equipment 100). For example, the body velocity BV(i) of the user 124 may be determined by measuring a first body position P(i−1) (e.g., the distance between the sacrum or chest and a reference point) at a heel strike of one foot of the user 124, measuring a second body position P(i) at the next heel strike of the other foot of the user 124, and dividing the difference between the two locations by the time between the heel strikes (the step time, $t_{step}$):

$$BV(i)=(P(i)-P(i-1))/t_{step}.$$

In other embodiments, the body velocity BV(i) of the user 124 may be determined by measuring a first body position P(i−1) at a heel strike of one foot of the user 124, measuring a second body position P(i) at the next heel strike of the same foot of the user 124, and dividing the difference between the two locations by the time between the hell strikes (the stride time, $t_{stride}$):

$$BV(i)=(P(i)-P(i-1))/t_{stride}.$$

Generally, the calculations and measurements disclosed herein may be discussed as indexed by a variable "i" associated with heel strikes (e.g., of the same foot or of alternating feet), but any suitable parameter may be used as an index variable.

In some embodiments, the sensor system 104 may generate the body position data and provide it to the velocity generation circuitry 106 (discussed below), which in turn may compute the body velocity based on the body position data (e.g., in accordance with the above technique). In some embodiments, the body velocity of the user 124 may be determined by integrating data representative of an acceleration of the torso or head of the user 124. In some embodiments, the body velocity of the user 124 may be determined by integrating data from multiple sensors of the sensor system 104 (e.g., by averaging or otherwise generating a weighted combination).

In some embodiments, the sensor system 104 may, during operation of the equipment 100, generate data representative of the leg swing velocity of the user 124. As used herein, "leg swing velocity" may refer to any suitable measurement of the speed of motion of a portion of a leg of the user 124. In various embodiments, the leg swing velocity may be a vector or scalar measurement. The leg swing velocity may represent the motion of a single particular location on the leg (e.g., the toe, the ankle, the calf, the knee, etc.) or a combination of the motion of two or more locations on the leg. At any given time, a measurement of the leg swing velocity of a user 124 may represent the motion of the one of the user's legs that is currently moving forward. For example, the leg swing velocity of a user 124 may be measured between the time of toe-off of the forward-moving leg and the time of heel strike of that leg. In some embodiments, the leg swing velocity of a user may be sampled at the same rate as heel strikes (e.g., one leg swing velocity measurement may correspond to forward movement of the left leg until the left heel strike, the next leg swing velocity measurement may correspond to forward movement of the right leg until the right heel strike, etc.).

The sensor system 104 may, during operation of the equipment 100, provide data representative of the body velocity of the user 124 and the legs and velocity of the user 124 to the velocity generation circuitry 106. The velocity generation circuitry 106 may receive this data wirelessly and/or via wires. In some embodiments, the sensor system 104 may itself provide the body velocity and the leg swing velocity to the velocity generation circuitry 106, while in other embodiments, the sensor system 104 may provide more "raw" data to the velocity generation circuitry 106 and the velocity generation circuitry 106 may process the raw data to determine the body velocity and the leg swing velocity. In some embodiments, the sensor system 104 may, during operation of the equipment 100, provide data representative of the body position of the user 124 to the velocity generation circuitry 106.

The velocity generation circuitry 106 may, during operation of the equipment 100 at a first equipment velocity (e.g., when the belt 132 of the treadmill of FIG. 2 is moving at a first velocity), generate a second equipment velocity for the equipment 100. As used herein, the term "equipment velocity" may be the velocity at which the equipment operates for the user 124. For example, the equipment velocity of the treadmill of FIG. 2 may be the velocity at which the belt 132 moves (and thus the rate at which the user 124 runs or walks). The equipment velocity of a stair climbing machine may be the rate at which new steps are presented to the user 124, and the equipment velocity of a Jacob's ladder machine may be the rate at which new rungs are presented to the user 124. The second equipment velocity may be different than the first equipment velocity, and the velocity generation circuitry 106 may determine the second equipment velocity based at least in part on the body velocity of the user 124 and the leg swing velocity of the user 124. In some embodiments, the velocity generation circuitry 106 may determine the second equipment velocity further based on the body position of the user 124. Example techniques for generating new equipment velocities are discussed in detail below with reference to FIGS. 7-12.

The velocity generation circuitry 106 may communicate (wirelessly or via wires) data representative of the second equipment velocity to the velocity adjustment circuitry 108, and the velocity adjustment circuitry 108 may cause the equipment 100 operate at the second equipment velocity. In some embodiments, the velocity generation circuitry 106 may communicate the value of the second equipment velocity to the velocity adjustment circuitry 108, while in other embodiments, the velocity generation circuitry 106 may communicate the difference between the second equipment velocity and the first equipment velocity to the velocity adjustment circuitry 108. In some embodiments, the velocity adjustment circuitry 108 may provide control signals to the auxiliary circuitry 112, and in response, the auxiliary circuitry 112 may cause the motor 110 to speed up or slow down to the second equipment velocity. In embodiments in which the auxiliary circuitry 112 is absent, as noted above, the velocity adjustment circuitry 108 may provide control signals directly to the motor 110. Example techniques for causing the equipment 100 to operate at new equipment velocities are discussed in detail below with reference to FIGS. 7-12. The motor 110 may include any suitable device, such as a DC motor or a stepper motor. Although a single motor 110 is shown in FIG. 1, this is simply for ease of illustration, and the equipment 100 may include any suitable number of motors 110 or other components whose velocity or other parameters may be adjusted in accordance with the techniques disclosed herein.

As noted above, the elements of the equipment 100 of FIG. 1 may be arranged in any of a number of ways. For example, with reference to FIG. 2, one or more elements of the sensor system 104 may be included in the circuitry 122 (positioned on the upper body of the user 124), the circuitry 120 (positioned on the leg or foot of the user 124), the circuitry 114 (in the upper housing 130-3 of the equipment 100, along with user interface controls and a display, not shown), the circuitry 116 (mounted to the arm housing 130-4), or the circuitry 118 (in the lower housing 130-1, along with the motor 110). Similarly, the velocity generation circuitry 106 and/or the velocity adjustment circuitry 108 may be included in any of these locations. In some embodiments, the auxiliary circuitry 112 may be included in the upper housing 130-3, the support housing 130-2, or the lower housing 130-1. These example locations are not limiting, and the elements of the equipment 100 may be distributed in any suitable manner, and may communicate with each other in any suitable manner (e.g., wirelessly or via wires).

Figure 3:
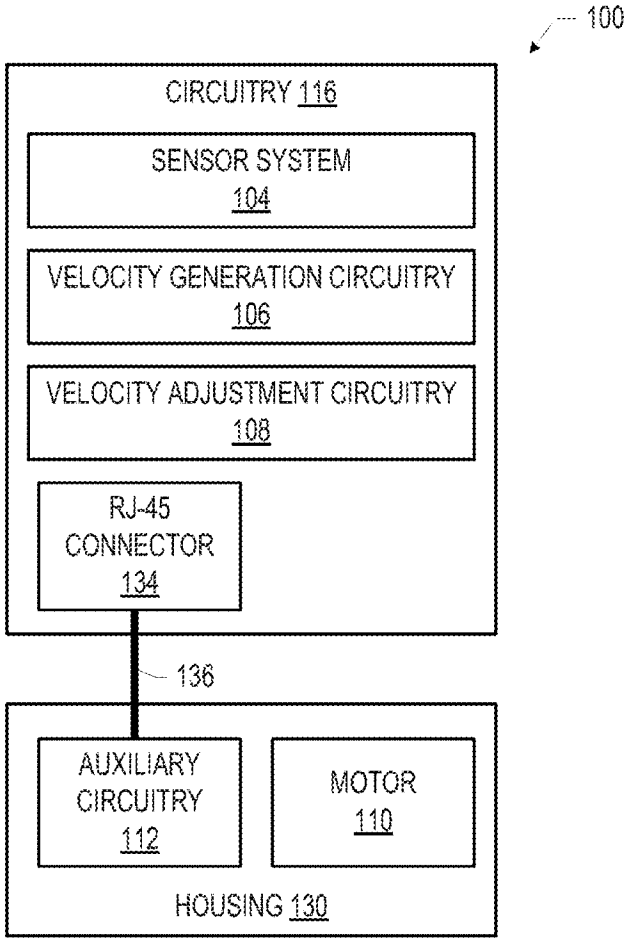
FIG. 3 is a block diagram of a particular arrangement of elements of the user-paced exercise equipment of FIG. 1, in accordance with various embodiments.

FIGS. 3-6 illustrate particular example arrangements of some of the elements of the equipment 100. For example, FIG. 3 is a block diagram of a particular arrangement of elements of the equipment 100 in accordance with various embodiments. In the embodiment of FIG. 3, the sensor system 104, the velocity generation circuitry 106, and the velocity adjustment circuitry 108 may be included at least partially in the circuitry 116 (mounted to the arm housing 130-4, as illustrated in FIG. 2). The circuitry 116 may further include an RJ-45 connector 134 to which an Ethernet cable 136 may couple. The other end of the Ethernet cable 136 may be coupled to the auxiliary circuitry 112 (e.g., via another RJ-45 connector) in a housing 130 along with the motor 110 (e.g., the lower housing 130-1). During operation, the velocity adjustment circuitry 108 may communicate equipment velocity control signals to the auxiliary circuitry 112 via the RJ-45 connector 134 and the Ethernet cable 136, and the auxiliary circuitry 112 may control the operation of the motor 110 so that the belt 132 achieves the desired equipment velocity. In some embodiments, the velocity adjustment circuitry 108 may use the Communications Specification for Fitness Equipment (CSAFE) protocol to communicate the desired equipment velocity with the auxiliary circuitry 112. The auxiliary circuitry 112 may be configured to decode this protocol, and provide appropriate signals to the motor 110 to achieve the desired equipment velocity. In other embodiments, other protocols may be used to encode data transmitted between the velocity adjustment circuitry 108 and the auxiliary circuitry 112.

Figure 4:
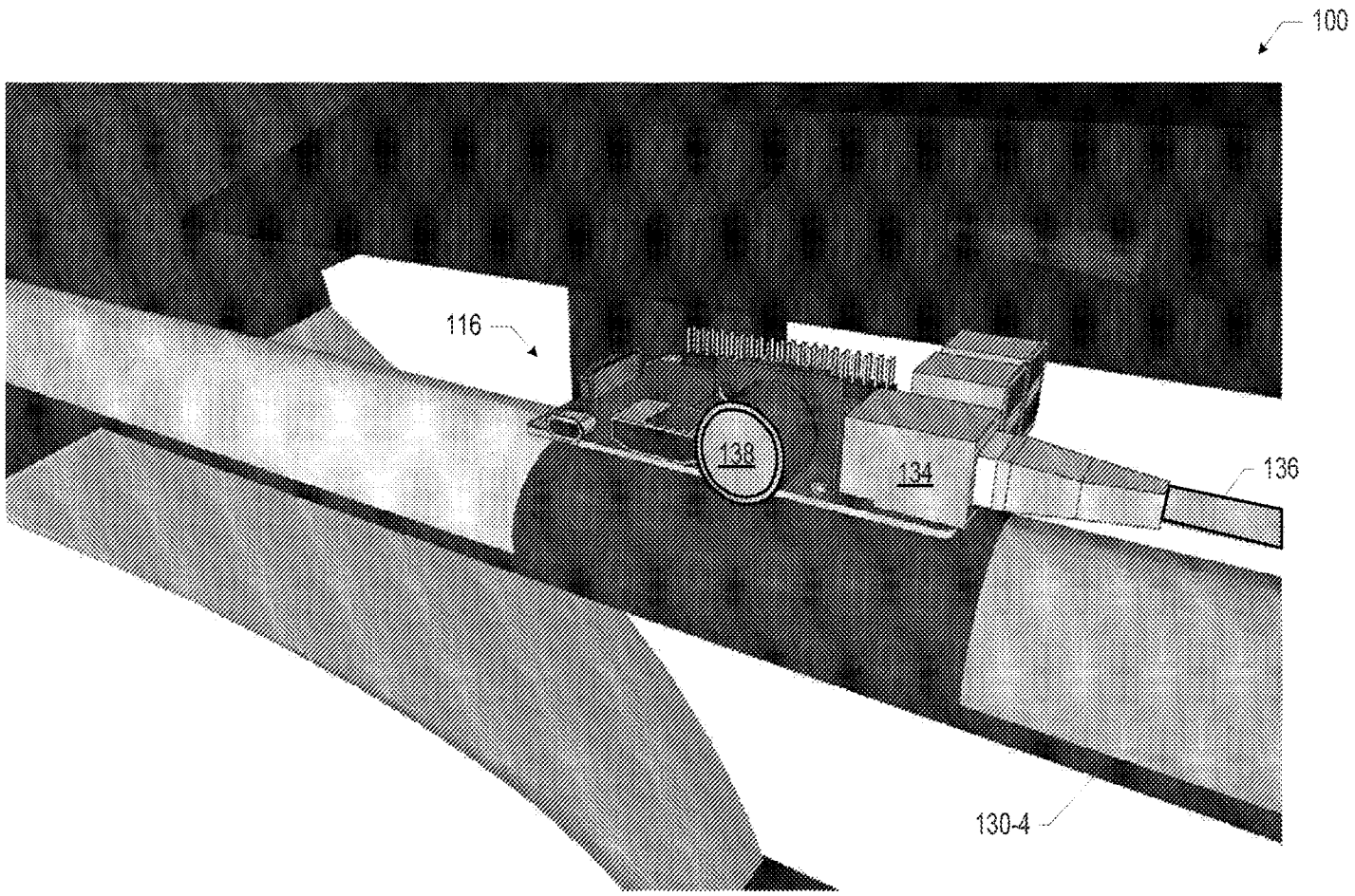
FIG. 4 is a perspective view of a portion of the arrangement of FIG. 3, in accordance with various embodiments.

FIG. 4 is a perspective view of a portion of the arrangement of FIG. 3, in accordance with various embodiments. In particular, FIG. 4 illustrates circuitry 116 mounted to an outer surface of the arm housing 130-4. The circuitry 116 may include a distance sensor 138, directed toward the user 124 and configured to measure the distance between the distance sensor 138 and the upper body of the user 124. The circuitry 116 may also include the velocity generation circuitry 106 (not labeled), the velocity adjustment circuitry 108 (not labeled), and an RJ-45 connector 134 to which an Ethernet cable 136 is coupled. The other end of the Ethernet cable 136 (not shown) may couple to an RJ-45 connector in a housing 130 of the equipment 100, as discussed above with reference to FIG. 3. A case or other housing (not shown) may be provided over the circuitry 116 to protect it. The circuitry 116 may be included in a dongle, in some embodiments. The arrangements of FIGS. 3 and 4 may be particularly suitable when a conventional piece of exercise equipment (e.g., a conventional treadmill compatible with the CSAFE protocol) is modified in accordance with the present disclosure to act as user-paced exercise equipment; the additional self-pacing circuitry may be included in the circuitry 116 and "plugged" into the conventional equipment (e.g., via an RJ-45 connector of the conventional equipment). Note that the location of the circuitry 116 on the arm housing 130-4 is simply illustrative, and the circuitry 116 may be mounted any suitable location on the equipment 100.

Figure 5:
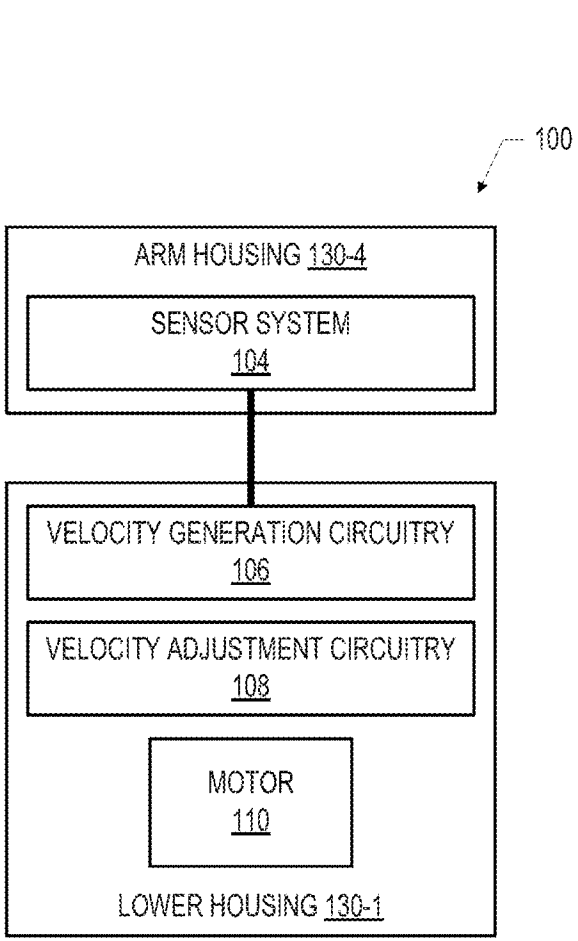
FIG. 5 is a block diagram of another particular arrangement of elements of the user-paced exercise equipment of FIG. 1, in accordance with various embodiments.
Figure 6:
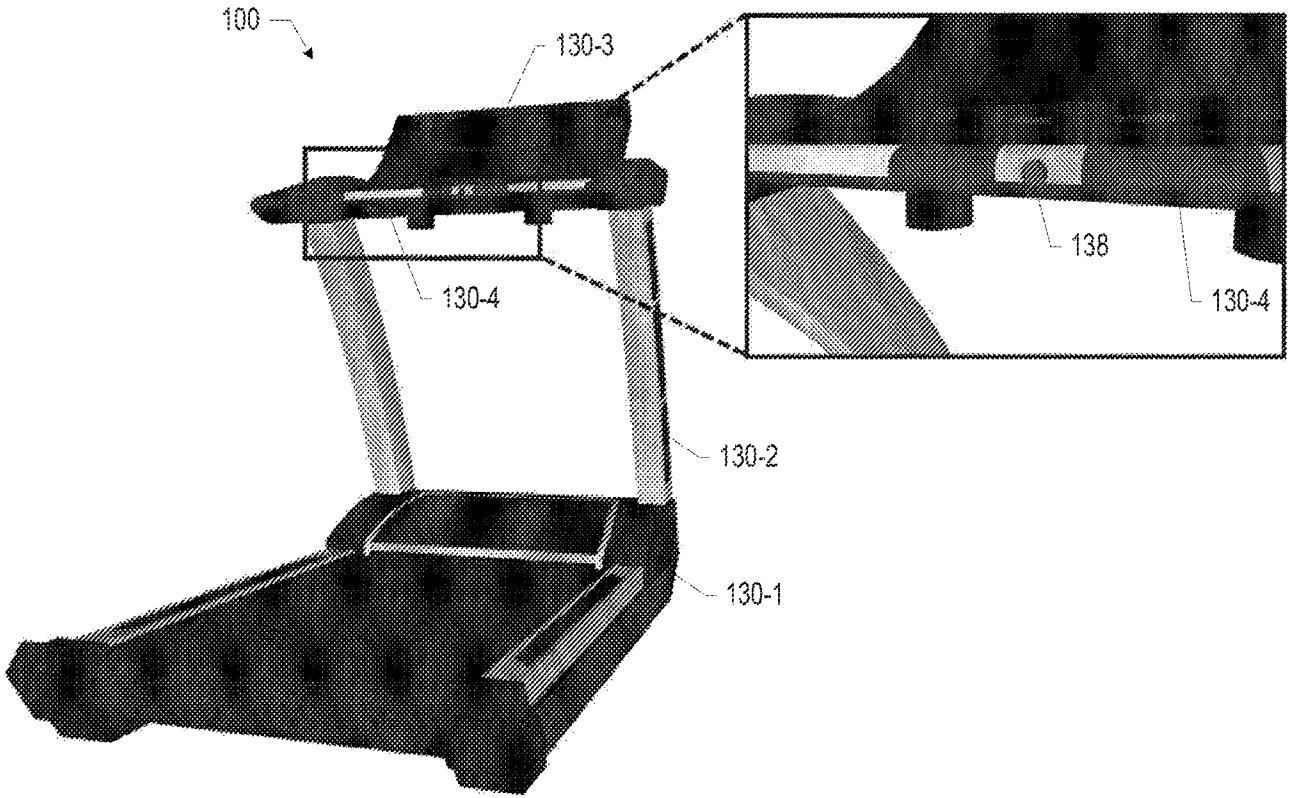
FIG. 6 is a perspective view of a portion of the arrangement of FIG. 5, in accordance with various embodiments.

FIG. 5 is a block diagram of another particular arrangement of elements of the equipment 100 in accordance with various embodiments. In the embodiment of FIG. 5, sensor system 104 may be included at least partially in the arm housing 130-4, and the velocity generation circuitry 106, the velocity adjustment circuitry 108, and the motor 110 may be included in the lower housing 130-1. During operation, the velocity adjustment circuitry 108 may control the operation of the motor 110 so that the belt 132 achieves the desired equipment velocity. FIG. 6 is a perspective view of a portion of the arrangement of FIG. 5, in accordance with various embodiments. In particular, FIG. 6 illustrates a distance sensor 138 integrated into the arm housing 130-4; the distance sensor 138 may communicate wirelessly or via wires (e.g., through the support housing 130-2) to the velocity generation circuitry 106 (not shown) included in the lower housing 130-1. The arrangements of FIGS. 5 and 6 may be particularly suitable when the self-pacing functionality disclosed herein is "built into" a piece of equipment 100; in such embodiments, the sensor system 104, the velocity generation circuitry 106, and the velocity adjustment circuitry 108 may be included in housings 130 of the equipment 100.

Figure 7:
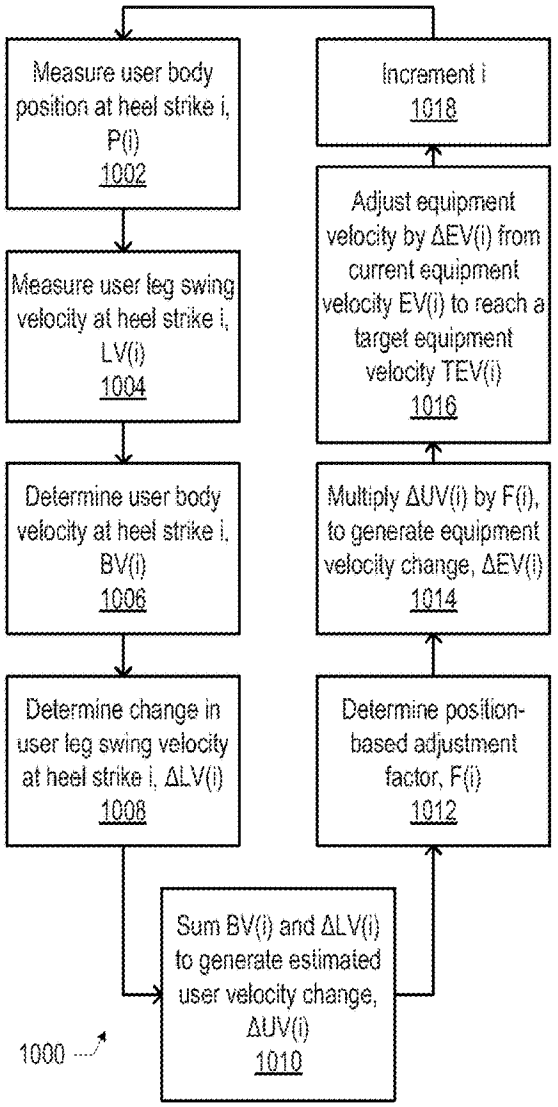
FIG. 7 is a flow diagram of a method of controlling an equipment velocity of a piece of exercise equipment, in accordance with various embodiments.

The velocity generation circuitry 106 and the velocity adjustment circuitry 108 may implement any of a number of techniques for providing the self-pacing functionality of the equipment 100. For example, FIG. 7 is a flow diagram of a method 1000 of controlling an equipment velocity of a piece of exercise equipment, in accordance with various embodiments. Various operations of the method 1000 may be performed by the sensor system 104, the velocity generation circuitry 106, or the velocity adjustment circuitry 108, as discussed below. As noted above, in the method 1000 (and the method 1200 of FIG. 12, discussed below), the heel strikes of the user 124 may be used to index various measurements and calculated parameters, but this is simply an example, and any suitable sampling rate or method may be used. Although the operations of the method 1000 (and the other methods discussed herein) may be illustrated with reference to particular embodiments of the equipment 100 disclosed herein, the method 1000 may be used to operate any suitable exercise equipment. Operations are illustrated once each and in a particular order in FIG. 7 (and in FIGS. 10 and 12), but the operations may be reordered, performed in parallel, and/or repeated as desired.

At 1002, the body position of the user 124 at heel strike i, P(i), may be measured. The measurement of P(i) may be performed in accordance with any of the embodiments discussed above with reference to the sensor system 104; in particular, any of the sensors discussed herein may be used in the measurement of P(i) in accordance with any of the embodiments of the body position discussed herein. In some embodiments, the measurement of P(i) may be performed by the velocity generation circuitry 106, based on data generated by the sensor system 104. For example, the sensor system 104 may include a camera that captures an image of the user 124 on the equipment 100, and the velocity generation circuitry 106 may process that image to determine P(i).

At 1004, the leg swing velocity of the user 124 at heel strike i, LV(i), may be measured. The measurement of LV(i) may be performed in accordance with any of the embodiments discussed above with reference to the sensor system 104; in particular, any of the sensors discussed herein may be used in the measurement of LV(i) in accordance with any of the embodiments of the leg swing velocity discussed herein. In some embodiments, the measurement of LV(i) may be performed by the velocity generation circuitry 106, based on data generated by the sensor system 104. For example, the sensor system 104 may include a camera that captures images of the user 124 on the equipment 100, and the velocity generation circuitry 106 may process those images to determine LV(i).

At 1006, the body velocity of the user 124 at heel strike i, BV(i), may be determined. When the user 124 is moving at a constant velocity, the body velocity of the user 124 may be very small (e.g., approximately 0); however, when the user 124 is changing her velocity, the body velocity may be non-zero. Thus, a non-zero body velocity at heel strike i, BV(i), may be an indicator of a change in the velocity of the user 124. In some embodiments, BV(i) may be determined by dividing the difference between the most recent body positions by the step time (or the stride time, as appropriate), as discussed above. In other embodiments, BV(i) may be determined in other ways (e.g., by integrating data from an accelerometer). The measurement of BV(i) may be performed in accordance with any of the embodiments discussed above with reference to the sensor system 104; in particular, any of the sensors discussed herein may be used in the measurement of BV(i) in accordance with any of the embodiments of the body velocity discussed herein. In some embodiments, the measurement of BV(i) may be performed by the velocity generation circuitry 106, based on data generated by the sensor system 104. For example, the sensor system 104 may include a camera that captures images of the user 124 on the equipment 100, and the velocity generation circuitry 106 may process those images to determine BV(i).

At 1008, a change in the user leg swing velocity at heel strike i, ΔLV(i), may be determined. When the user 124 is moving at a constant velocity, the user leg swing velocity may not significantly change from heel strike to heel strike; however, when the user 124 is changing her velocity, the user leg swing velocity may change from heel strike to heel strike. Thus, the change in the user leg swing velocity at heel strike i, ΔLV(i), may be an indicator of a change in the velocity of the user 124. In some embodiments, the velocity generation circuitry 106 may determine ΔLV(i) in accordance with:

$$\Delta LV(i)=LV(i)-LV(i-1).$$

At 1010, the user body velocity BV(i) and the change in the user leg swing velocity ΔLV(i) may be summed (e.g., by the velocity generation circuitry 106) to generate an estimated user velocity change at heel strike i, ΔUV(i):

$$\Delta UV(i)=LV(i)-BV(i).$$

At 1012, a position-based adjustment factor at heel strike i, F(i), may be determined (e.g., by the velocity generation circuitry 106). Generally, the position-based adjustment factor may be used to address the fact that, when the user 124 is at the "front" end or the "back" end of the position range of the equipment 100, it is more difficult for her to significantly change her body velocity or leg swing velocity naturally (to cause a change in the equipment velocity) because of the physical constraints of the equipment 100.

In the method 1000, the position-based adjustment factor may be used to adjust the estimated user velocity change ΔUV(i) when generating the equipment velocity change (discussed below) based on the position of the user 124 on the equipment 100 (e.g., the position of the user 124 along the belt 132 of a treadmill). In particular, in the method 1000, the position-based adjustment factor may additionally increase the "new" equipment velocity when the estimated user velocity change ΔUV(i) is positive and the user 124 is positioned closer to the "front" of the position range of the equipment 100 than to the "back" of the position range of the equipment 100. FIG. 2 illustrates the position range 135 of the illustrated treadmill, with the front 133 and the back 131 labeled. Analogous "fronts" and "backs" of different types of exercise equipment, such as stair climbing machines, or Jacob's ladder machines, may be identified. In the method 1000, the position-based adjustment factor may also additionally decrease the "new" equipment velocity when the estimated user velocity change ΔUV(i) is negative and the user 124 is positioned closer to the back of the position range of the equipment 100 than to the front of the position range of the equipment 100. Further, in the method 1000, the position-based adjustment factor may scale back the increase in the "new" equipment velocity when the estimated user velocity change ΔUV(i) is positive and the user 124 is positioned closer to the back of the position range than to the front of the position range, and the position-based adjustment factor may scale back the decrease in the "new" equipment velocity when the estimated user velocity change ΔUV(i) is negative and the user 124 is positioned closer to the front of the position range than to the back of the position range. Using position-based adjustment factors as described herein with reference to the method 1000 (and as described below with reference to the method 1200), may allow the equipment velocity to increase or decrease, regardless of the position of the user 124 on the equipment 100, while improving safety by keeping the user 124 on the equipment 100.

Figure 8:
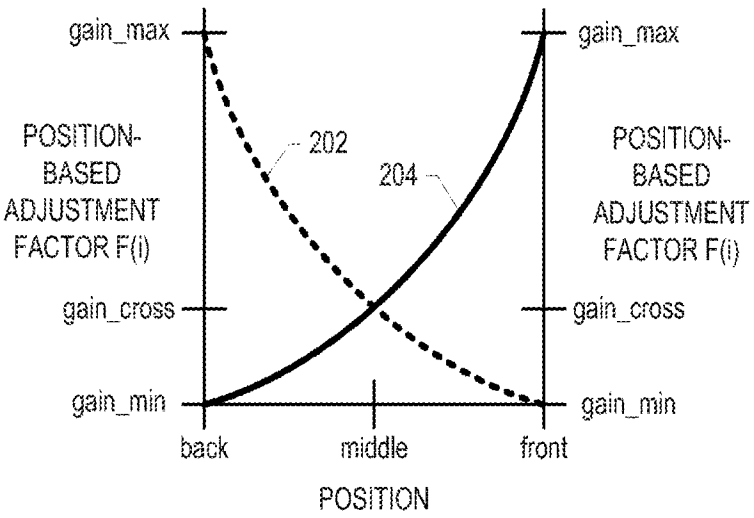
FIGS. 8 and 9 are plots of example position-based adjustment factors that may be used when controlling an equipment velocity of a piece of exercise equipment, in accordance with various embodiments.
Figure 9:
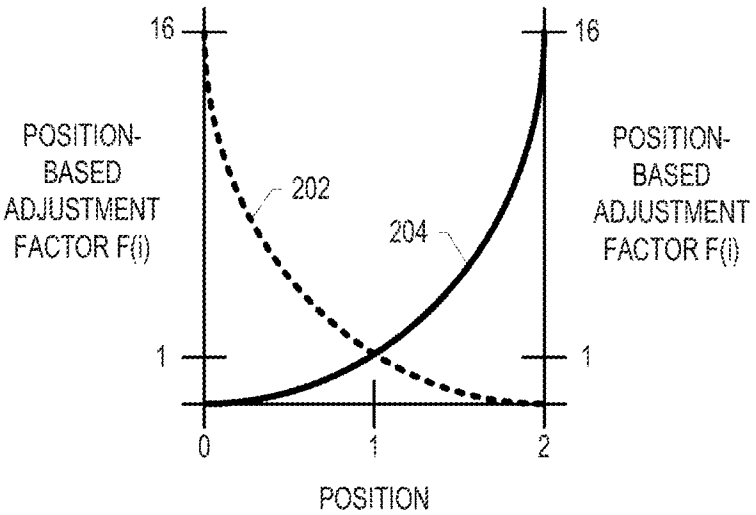

FIGS. 8 and 9 are plots of example position-based adjustment factors that may be used at 1012 in the method 1000 of FIG. 7, in accordance with various embodiments. In particular, FIGS. 8 and 9 each illustrate a positive estimated user velocity change curve 204, and a negative estimated user velocity change curve 202. Each of these curves 202 and 204 is a function of the position P(i) of the user on the equipment 100. When the estimated user velocity change ΔUV(i) is positive, the curve 204 may be used to determine F(i), and when the estimated user velocity change ΔUV(i) is negative, the curve 202 may be used to determine F(i). The curves 202 and 204 cross at a gain_cross value when the user 124 is positioned in the middle of the position range; this gain_cross value may be 1, so that when the user 124 is positioned in the middle of the position range (e.g., equally spaced between the front 133 and the back 131 of the treadmill of FIG. 2), the position-based adjustment factor does not affect the determination of the "new" equipment velocity. In FIGS. 8 and 9, the gain_cross value is located at a single point in the middle of the position range, but this need not be the case; in other embodiments, the gain_cross value may be located at a point or points not in the middle of the position range (e.g., based on the location in the position range at which the user 124 prefers to walk or run), or may be located at a continuous range of points. For example, in some embodiments, the location of the gain_cross value may be at the starting point of the user 124 on the equipment 100. The positive estimated user velocity change curve 204 may reach a maximum value gain_max when the user is at the front of the position range, and may reach a minimum value gain_min when the user is at the back of the position range (and vice versa for the negative estimated user velocity change curve 202). Although FIG. 8 illustrates the curves 202 and 204 as having the same values of gain_max and gain_min, this need not be the case, and the curves 202 and 204 may have different values of gain_max and/or gain_min. More generally, the curves 202 and 204 may have any suitable functional forms (e.g., depending upon the other capabilities of the equipment 100 and/or any relevant characteristics of the user 124).

FIG. 9 illustrates a particular example of a functional form for the position-based adjustment factor; when the estimated user velocity change ΔUV(i) is positive, the curve 204 may be described by $$F(i)=(P(i)*(2/\text{range}))^4,$$

and when the estimated user velocity change ΔUV(i) is negative, the curve 202 may be described by $$F(i)=((P(i)-\text{range})*(2/\text{range})^4,$$

where "range" is the total length of the range. In FIG. 9, the value of "range" is assumed to be 2, with the front end of the range located at 2, and the back end of the range located at 0. In the embodiment of FIG. 9, the gain_cross value is 1, the gain_min value is 0, and the gain_max value is 16. In other embodiments, when the estimated user velocity change ΔUV(i) is positive, the curve 204 may be described by $$F(i)=(P(i)*(2/\text{range}))^p,$$

and when the estimated user velocity change ΔUV(i) is negative, the curve 202 may be described by $$F(i)=((P(i)-\text{range})*(2/\text{range})^p,$$

where the value of "p" is different than four.

Returning to FIG. 7, once the position-based adjustment factor F(i) has been determined at 1012, the estimated user velocity change ΔUV(i) may be multiplied by the position-based adjustment factor F(i) (e.g., by the velocity generation circuitry 106) at 1014 to generate an equipment velocity change ΔEV(i):

$$\Delta\text{EV}(i)=\Delta\text{UV}(i)*F(i).$$

At 1016, the velocity of the equipment 100 may be changed from the current equipment velocity EV(i) by the equipment velocity change ΔEV(i) to reach a target equipment velocity TEV(i):

$$\text{TEV}(i)=\text{EV}(i)+\Delta\text{EV}(i).$$

At 1018, the value of the index i may be incremented (corresponding, e.g., to the next heel strike), and the method 1000 may return to 1002.

In some embodiments, the velocity adjustment circuitry 108 may provide ΔEV(i) or TEV(i) to the auxiliary circuitry 112 at 1016 (e.g., via the CSAFE protocol), and the auxiliary circuitry 112 may control the change in the speed of the motor 110 to achieve the target equipment velocity TEV(i). In other embodiments, the velocity adjustment circuitry 108 may provide more granular instructions to the auxiliary circuitry 112 (or directly to the motor 110) at 1016, specifying the particular incremental increases in the speed of the motor 110 over different subsequent sample periods to achieve a target equipment velocity TEV(i) while controlling the acceleration at which that equipment velocity is achieved.

Figure 10:
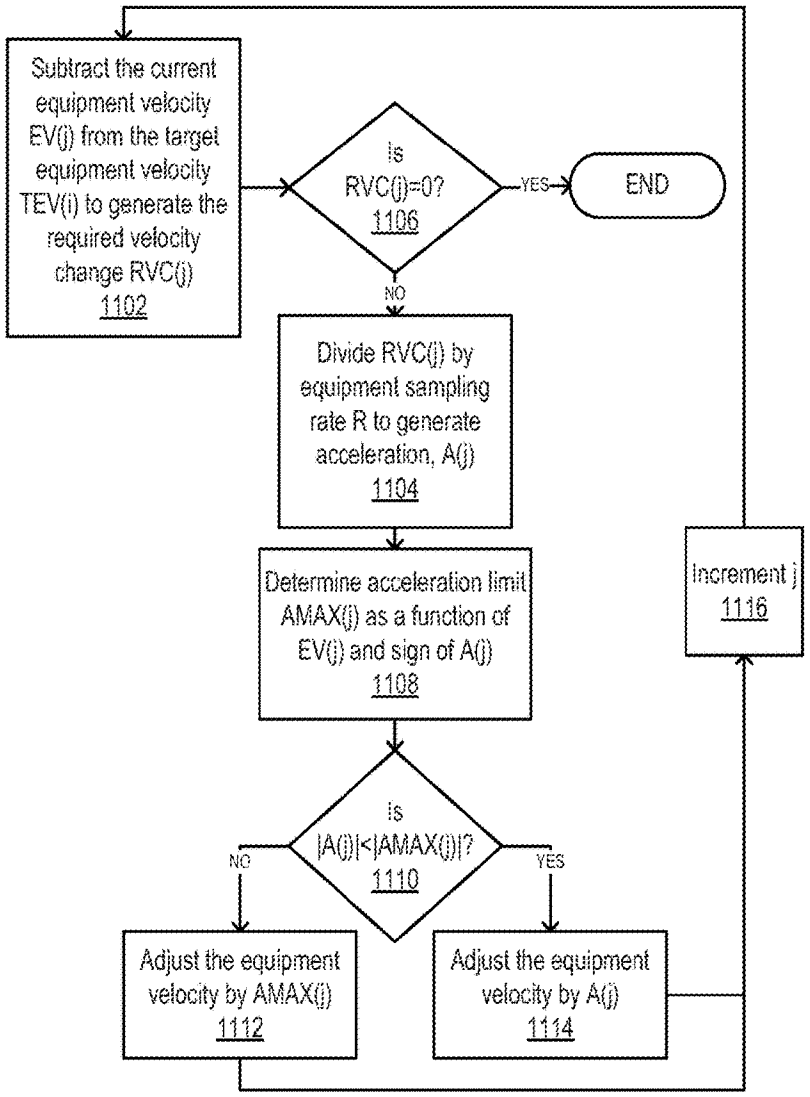
FIG. 10 is a flow diagram of a method of controlling an equipment acceleration of a piece of exercise equipment, in accordance with various embodiments.

For example, FIG. 10 is a flow diagram of a method 1100 of controlling an equipment acceleration of a piece of exercise equipment, in accordance with various embodiments. The velocity generation circuitry 106 or the velocity adjustment circuitry 108 may execute the method 1100 at the operation 1016 of FIG. 7 as part of controlling the rate at which the equipment velocity changes toward the target equipment velocity EV(i)+ΔEV(i). Operations of the method 1100 are discussed as indexed by an index j, which may correspond to the sampling rate R of the equipment 100.

At 1102, the required velocity change RVC(j) may be determined (e.g., by the velocity generation circuitry 106 or the velocity adjustment circuitry 108) by determining the difference between the target equipment velocity TEV(i) and the current equipment velocity EV(j):

$$\text{RVC}(j)=\text{TEV}(i)-\text{EV}(j).$$

At 1104, the required velocity change RVC(j) may be compared to zero (e.g., by the velocity generation circuitry 106 or the velocity adjustment circuitry 108) to determine if the current equipment velocity EV(j) has reached the target equipment velocity TEV(i) (and thus the required velocity change RVC(j) is zero or approximately zero). If the current equipment velocity EV(j) has reached the target equipment velocity TEV(i), the method 1100 may end.

If the current equipment velocity EV(j) has not yet reached the target equipment velocity TEV(i), the method 1100 may proceed to 1106, at which the required velocity change RVC(j) may be divided (e.g., by the velocity generation circuitry 106 or the velocity adjustment circuitry 108) by the equipment sampling rate R to generate an acceleration A(j):

$$A(j)=\text{RVC}(j)R.$$

At 1108, an acceleration limit AMAX(j) may be determined (e.g., by the velocity generation circuitry 106 or the velocity adjustment circuitry 108). The acceleration limit AMAX(j) may be a function of the equipment velocity EV(j) and the sign (positive or negative) of the acceleration A(j). The absolute value of the acceleration limit AMAX(j) may decrease as the equipment velocity EV(j) increases.

Figure 11:
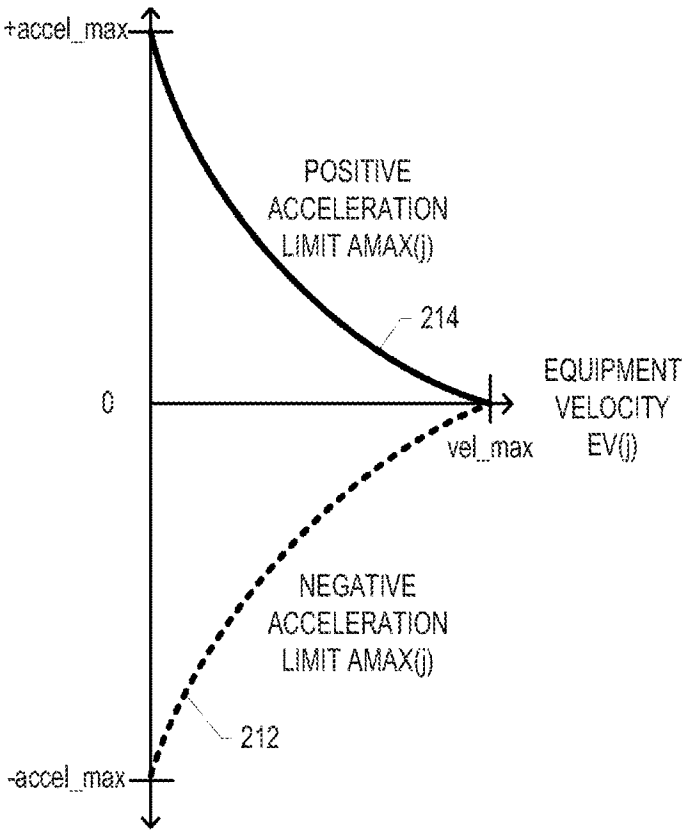
FIG. 11 is a plot of example acceleration limits that may be used when controlling an equipment acceleration of a piece of exercise equipment, in accordance with various embodiments.

FIG. 11 is a plot of example acceleration limits that may be used when controlling an equipment acceleration of the equipment 100, in accordance with various embodiments. FIG. 11 includes a positive acceleration limit curve 214, and a negative acceleration limit curve 212. When the acceleration A(j) is positive, the positive acceleration limit curve 214 may be used; when the acceleration A(j) is negative, the negative acceleration limit curve 212 may be used. Each of the acceleration limit curves 212 and 214 may provide an acceleration limit value AMAX(j) as a function of the current equipment velocity EV(j). The acceleration limit curves 212 and 214 each reach a value of zero when the current equipment velocity EV(j) is equal to a maximum velocity of the equipment 100 (vel_max). In the embodiment of FIG. 11, the acceleration limit curves 212 and 214 each reach their largest absolute values (equal to accel_max) when the current equipment velocity EV(j) is 0. Although FIG. 11 illustrates an embodiment in which the acceleration limit curves 212 and 214 have the same largest absolute values, this need not be the case; more generally, the acceleration limit curves 212 and 214 may have different shapes.

Returning to FIG. 10, once the acceleration limit AMAX (j) has been determined at 1108, the method 1100 may proceed to 1110, at which the absolute value of the acceleration AO) may be compared to the absolute value of the acceleration limit AMAX(j) (e.g., by the velocity generation circuitry 106 or the velocity adjustment circuitry 108). If the absolute value of the acceleration A(j) is less than or equal to the absolute value of the acceleration limit AMAX(j), the method 1100 may proceed to 1114 and the equipment velocity may be changed by the acceleration A(j) (e.g., by the velocity adjustment circuitry 108).

If the absolute value of the acceleration A(j) is determined at 1110 to be greater than the absolute value of the acceleration limit AMAX(j), the method 1100 may proceed to 1112, and the equipment velocity may be changed by AMAX(j). After 1112 or 1114, the method 1100 may proceed to increment j at 1116, then return to 1102.

Figure 12:
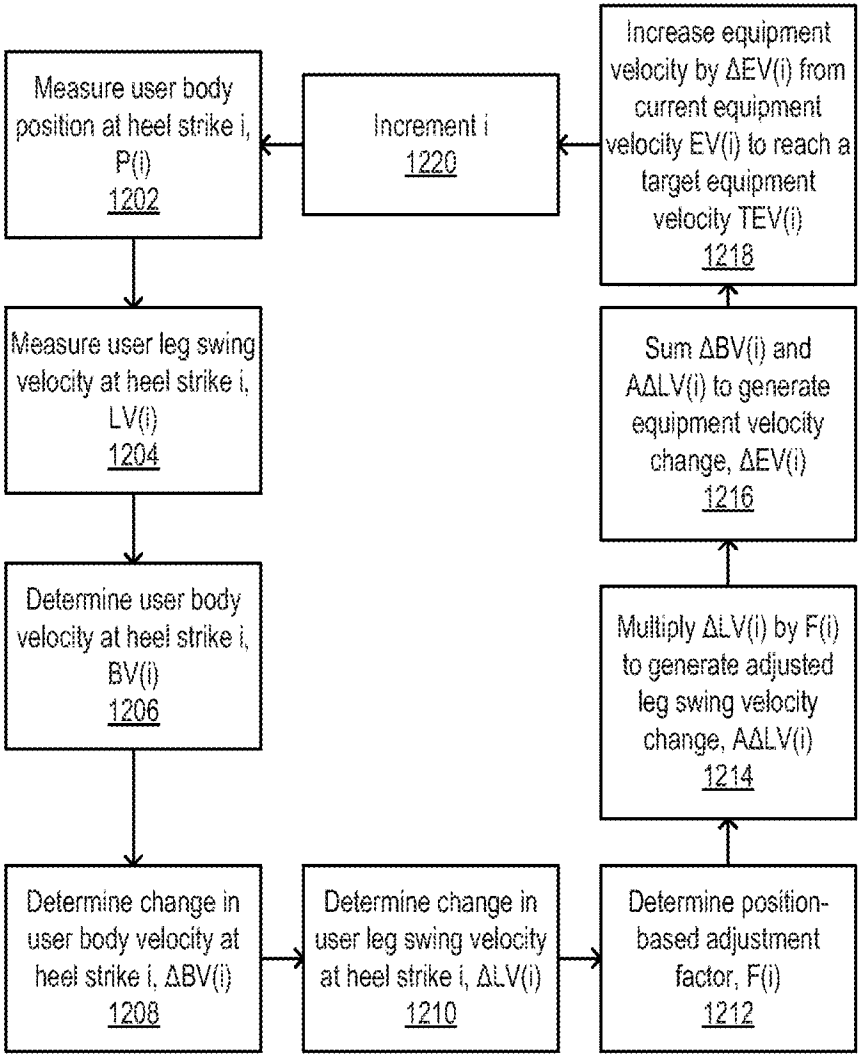
FIG. 12 is a flow diagram of another method of controlling an equipment velocity of a piece of exercise equipment, in accordance with various embodiments.

FIG. 12 is a flow diagram of another method 1200 of controlling an equipment velocity of equipment 100, in accordance with various embodiments. At 1202, the body position of the user 124 at heel strike i, P(i), may be measured. The operations of 1202 may be performed in accordance with any of the embodiments discussed above with reference to 1002 (FIG. 7).

At 1204, the leg swing velocity of the user 124 at heel strike i, LV(i), may be measured. The operations of 1204 may be performed in accordance with any of the embodiments discussed above with reference to 1004 (FIG. 7).

At 1206, the body velocity of the user 124 at heel strike i, BV(i), may be determined. The operations of 1206 may be performed in accordance with any of the embodiments discussed above with reference to 1006 (FIG. 7).

At 1208, a change in the user's body velocity at heel strike i, ΔBV(i), may be determined. In some embodiments, the velocity generation circuitry 106 may determine ΔBV(i) in accordance with:

$$\Delta BV(i)=BV(i)-BV(i-1).$$

At 1210, a change in the user leg swing velocity at heel strike i, ΔLV(i), may be determined. The operations of 1210 may be performed in accordance with any of the embodiments discussed above with reference to 1008 (FIG. 7).

At 1212, a position-based adjustment factor at heel strike i, F(i), may be determined (e.g., by the velocity generation circuitry 106). In the method 1200, the position-based adjustment factor may be used to adjust the leg swing velocity change ΔLV(i) when generating the equipment velocity change (discussed below) based on the position of the user 124 on the equipment 100. The position-based adjustment factor of the method 1200 may be computed in accordance with any of the embodiments discussed above with reference to FIGS. 7-9.

At 1214, the leg swing velocity change ΔLV(i) may be multiplied by the position-based adjustment factor F(i) (e.g., by the velocity generation circuitry 106) to generate an adjusted leg swing velocity change AΔLV(i):

$$A\Delta LV(i)=\Delta LV(i)*F(i).$$

At 1216, the change in user body velocity ΔBV(i) may be added to the adjusted leg swing velocity change AΔLV(i) (e.g., by the velocity generation circuitry 106) to generate an equipment velocity change ΔEV(i):

$$\Delta EV(i)=\Delta BV(i)+A\Delta LV(i).$$

At 1218, the velocity of the equipment 100 may be changed from the current equipment velocity EV(i) by the equipment velocity change ΔEV(i) to reach a target equipment velocity TEV(i):

$$TEV(i)=EV(i)+\Delta EV(i).$$

The operations of 1218 may include incrementally adjusting the equipment velocity while obeying an acceleration limit, as discussed above with reference to FIGS. 10 and 11. Thus, in some embodiments, the method 1100 of FIG. 10 may be performed as part of 1218, in accordance with any of the embodiments discussed herein.

At 1220, the value of the index i may be incremented (corresponding, e.g., to the next heel strike), and the method 1200 may return to 1202.

In some embodiments in which the equipment 100 is a treadmill, the position-based adjustment factors and/or the acceleration limits used when changing the equipment velocity (e.g., as discussed above with reference to FIGS. 7-12) may depend on whether the user 124 is walking or running. For example, a first set of curves 202 and 204 may be used to provide the position-based adjustment factors when the user 124 is walking, and a different second set of curves 202 and 204 (e.g., having different shapes, maximum values, and/or minimum values than the first set of curves 202 and 204) when the user 124 is running. Thus, the operations of the method 1000 performed at 1012 (and/or the operations of the method 1200 performed at 1212) may, in some embodiments, include determining whether the user 124 is walking or running, selecting an appropriate set of curves 202 and 204, and then determining the position-based adjustment factor F(i) based on the selected set of curves 202 and 204.

Similarly, in some embodiments, a first set of curves 212 and 214 may be used to provide the acceleration limits when the user 124 is walking, and a different second set of curves 212 and 214 (e.g., having different shapes, maximum values, and/or minimum values than the first set of curves 212 and 214) when the user 124 is running. Thus, the operations of the method 1100 performed at 1108 may, in some embodiments, include determining whether the user 124 is walking or running, selecting an appropriate set of curves 212 and 214, and then determining the acceleration limit AMAX(j) based on the selected set of curves 212 and 214.

Any of a number of techniques may be used to determine whether the user 124 is walking or running. For example, the velocity generation circuitry 106 may determine whether a foot of the user 124 is in contact with the belt 132 of the treadmill for more than 50 percent of the time (i.e., whether the duty cycle is greater than 0.5). If a foot of the user 124 is in contact with the belt 132 more than 50 percent of the gait cycle, the velocity generation circuitry 106 may conclude that the user 124 is walking. If a foot of the user 124 is in contact with the belt 132 less than 50 percent of the gait cycle, the velocity generation circuitry 106 may conclude that the user 124 is running. Any other suitable techniques for determining whether the user 124 is walking or running may be implemented by the velocity generation circuitry 106. The velocity generation circuitry 106 may use any appropriate data from the sensor system 104 to determine whether the user 124 is walking or running, such as data from image sensors, data from accelerometers mounted at the ankles or feet of the user 124 (e.g., when the acceleration of a foot in the plane parallel to the belt 132 is near zero, the foot is likely on the belt 132), or any other suitable data.

Figure 13:
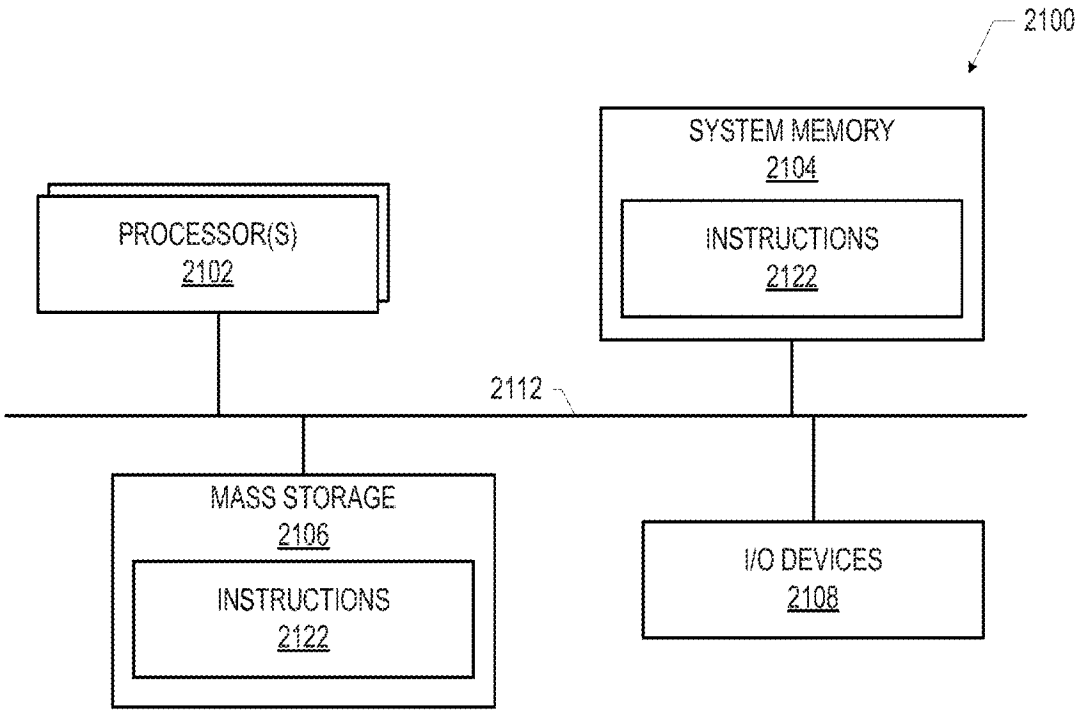
FIG. 13 is a block diagram of example computing circuitry that may be suitable for use in practicing various ones of the disclosed embodiments.

FIG. 13 is a block diagram of example computing circuitry 2100 suitable for use in practicing various ones of the disclosed embodiments. For example, the computing circuitry 2100 may be included in the control circuitry 102, and may provide parts of one or more of the sensor system 104, the velocity generation circuitry 106, or the velocity adjustment circuitry 108. In some embodiments, the computing circuitry 2100 may also provide the auxiliary circuitry 112. As shown, the computing circuitry 2100 may include one or more processors 2102 (e.g., one or more processor cores) and a system memory 2104. For the purpose of this application, including the claims, the terms "processor" and "processor cores" may be considered synonymous, unless the context clearly requires otherwise. As used herein, the term "processor" or "processing device" may refer to any device or portion of a device that processes electronic data from registers and/or memory to transform that electronic data into other electronic data that may be stored in registers and/or memory. The processor(s) 2102 may include one or more microprocessors, graphics processors, digital signal processors, crypto processors, or other suitable devices.

The computing circuitry 2100 may include one or more mass storage devices 2106 (such as diskettes, hard drives, solid-state drives, CD-ROMs, flash memory devices, and so forth). The system memory 2104 and the mass storage device 2106 may include any suitable storage devices, such as volatile memory (e.g., dynamic random access memory (DRAM)), nonvolatile memory (e.g., read-only memory (ROM), and flash memory. The computing circuitry 2100 may include one or more I/O devices 2108 (such as display, keyboard, cursor control, network interface cards, modems, and so forth). The I/O devices 2108 may include the sensor system 104 (e.g., in accordance with any of the embodiments disclosed herein). The elements may be coupled to each other via a system bus 2112, which represents one or more buses. In the case of multiple buses, they may be bridged by one or more bus bridges (not shown). The velocity generation circuitry 106 and the velocity adjustment circuitry 108 may be implemented by a processing device (e.g., a general-purpose processing device programmed with appropriate instructions, an application-specific integrated circuit (ASIC), or any other suitable combination of logic elements) and a memory in communication with the processing device to store appropriate data (e.g., any of the variables and parameters discussed above with reference to FIGS. 7-12). As noted above, some or all of the hardware of the velocity generation circuitry 106 and the velocity adjustment circuitry 108 may be shared between the velocity generation circuitry 106 and the velocity adjustment circuitry 108. For example, one programmed processing device and one memory may provide the velocity generation circuitry 106 and the velocity adjustment circuitry 108.

Each of the elements of the computing circuitry 2100 may perform its conventional functions known in the art. In particular, the system memory 2104 and the mass storage device 2106 may be employed to store a working copy and a permanent copy of programming instructions implementing any of the methods disclosed herein (e.g., the method of any of FIG. 7, 10, or 12), or portions thereof, herein collectively denoted as instructions 2122. Various methods and system components may be implemented by assembler instructions supported by processor(s) 2102 or high-level languages, such as, for example, C, that can be compiled into such instructions. For example, the computing circuitry 2100 configured with suitable instructions 2122 may provide some or all of the control circuitry 102.

The permanent copy of the programming instructions may be placed into permanent mass storage devices 2106 in the factory, or in the field through, for example, a machine-accessible distribution medium (not shown), such as a compact disc (CD) or a solid-state memory device (e.g., a Universal Serial Bus drive), or through a communication device included in the I/O devices 2108 (e.g., from a distribution server (not shown)). That is, one or more distribution media having an implementation of the agent program may be employed to distribute the agent and program various computing devices. The constitution of elements 2102-2112 are known, and accordingly will not be further described.

Machine-accessible media (including non-transitory computer-readable storage media), methods, systems, and devices for performing the above-described techniques are illustrative examples of embodiments disclosed herein. For example, a computer-readable media (e.g., the system memory 2104 and/or the mass storage device 2106) may have stored thereon instructions (e.g., the instructions 2122) such that, when the instructions are executed by one or more processors 2102, the instructions cause the computing circuitry 2100 to perform any of the methods disclosed herein.

The computing circuitry 2100 may be part of a user-paced exercise equipment 100. For example, some or all of the components of the computing circuitry 2100 may be included in a housing of a user-paced exercise equipment 100 (e.g., any of the housings 130 discussed above with reference to FIGS. 2-6). In some embodiments, some or all of the components of the computing circuitry 2100 may be in wired or wireless communication with other components in a housing of a user-paced exercise equipment 100. The components of the computing circuitry 2100 that are not included in a housing of a user-paced exercise equipment 100 may be included in a laptop, a netbook, a notebook, an ultrabook, a smartphone, a tablet, a personal digital assistant (PDA), an ultra mobile PC, a mobile phone, a desktop computer, a server, a printer, a scanner, a monitor, a set-top box, an entertainment control unit, a digital camera, a portable music player, a digital video recorder, a wearable computing device (e.g., a smartwatch or chest band), or secured to a circuit board that is wearable by a user or attached to the user-paced exercise equipment 100. In some implementations, the computing circuitry 2100 may include any other electronic device that processes data.

The following paragraphs provide examples of various ones of the embodiments disclosed herein.

Example 1 is a control apparatus for exercise equipment, including: a sensor system to generate data representative of a body velocity of a user of the exercise equipment, and a leg swing velocity of the user, when the exercise equipment is operating at a first equipment velocity; velocity generation circuitry to generate a second equipment velocity for the exercise equipment based at least in part on the body velocity and the leg swing velocity; and velocity adjustment circuitry to cause the exercise equipment to operate at the second equipment velocity.

Example 2 may include the subject matter of Example 1, and may further specify that generate a second equipment velocity for the exercise equipment includes determine a change in equipment velocity for, wherein the second equipment velocity is equal to the first equipment velocity plus the change in equipment velocity.

Example 3 may include the subject matter of any of Examples 1-2, and may further specify that the velocity adjustment circuitry is to communicate the second equipment velocity, or a difference between the first equipment velocity and the second equipment velocity, to a processor that controls a motor of the exercise equipment.

Example 4 may include the subject matter of Example 3, and may further specify that the control apparatus is to communicate with the processor using a Communications Specification for Fitness Equipment (CSAFE) protocol.

Example 5 may include the subject matter of any of Examples 3-4, and may further specify that the control apparatus is to communicate with the processor via an Ethernet cable.

Example 6 may include the subject matter of any of Examples 3-5, and may further specify that the velocity generation circuitry is located in a housing of the exercise equipment.

Example 7 may include the subject matter of any of Examples 1-6, and may further specify that the velocity adjustment circuitry is to provide electrical signals to a motor of the exercise equipment to cause the exercise equipment to operate at the second equipment velocity.

Example 8 may include the subject matter of Example 7, and may further specify that the velocity generation circuitry is located in a housing of the exercise equipment.

Example 9 may include the subject matter of any of Examples 1-7, and may further specify that the velocity generation circuitry is secured to a handle of the exercise equipment.

Example 10 may include the subject matter of any of Examples 1-9, and may further specify that the exercise equipment is a treadmill.

Example 11 may include the subject matter of any of Examples 1-10, and may further specify that the exercise equipment includes a stepper motor or a DC motor.

Example 12 may include the subject matter of any of Examples 1-11, and may further specify that the sensor system includes a camera, a distance sensor, or an accelerometer.

Example 13 may include the subject matter of any of Examples 12, and may further specify that the sensor system includes at least one sensor to communicate wirelessly with the velocity generation circuitry.

Example 14 may include the subject matter of any of Examples 1-13, and may further specify that the sensor system is to generate data representative of a position of the user relative to the exercise equipment, and the velocity generation circuitry is to determine the second equipment velocity based at least in part on the position.

Example 15 may include the subject matter of Example 14, and may further specify that the velocity generation circuitry is to determine an adjustment factor based at least in part on the position.

Example 16 may include the subject matter of Example 15, and may further specify that the adjustment factor increases an influence of the leg swing velocity in the determination of the second equipment velocity as the position gets closer to an end of a position range of the exercise equipment.

Example 17 may include the subject matter of any of Examples 15-16, and may further specify that the adjustment factor is to cause the second equipment velocity to be greater than or less than an estimated user velocity.

Example 18 may include the subject matter of any of Examples 15-17, and may further specify that the velocity generation circuitry is to determine whether the user is running or walking, and to determine the adjustment factor based at least in part on whether the user is running or walking.

Example 19 may include the subject matter of any of Examples 1-18, and may further specify that the velocity generation circuitry is to determine the second equipment velocity based at least in part on an acceleration limit.

Example 20 may include the subject matter of Example 19, and may further specify that the acceleration limit decreases as an equipment velocity of the exercise equipment increases.

Example 21 may include the subject matter of any of Examples 19-20, and may further specify that the velocity generation circuitry is to determine whether the user is running or walking, and to determine the acceleration limit based at least in part on whether the user is running or walking.

Example 22 may include the subject matter of any of Examples 1-21, and may further specify that the velocity generation circuitry is to determine the second equipment velocity based at least in part on a difference between the body velocity and a previously determined value of the body velocity.

Example 23 may include the subject matter of any of Examples 1-22, and may further specify that the velocity generation circuitry is to determine the second equipment velocity based at least in part on a difference between the leg swing velocity and a previously determined value of the leg swing velocity.

Example 24 is a user-paced treadmill, including: a belt; a motor coupled to the belt; and control circuitry, communicatively coupled to the motor, to adjust a belt velocity based at least in part on a body velocity and a leg swing velocity of a user of the user-paced treadmill.

Example 25 may include the subject matter of Example 24, and may further specify that the control circuitry is to adjust the belt velocity based at least in part on a position of the user on the user-paced treadmill.

Example 26 may include the subject matter of Example 25, and may further specify that the control circuitry is to adjust the belt velocity based at least in part on an acceleration limit function that depends on a current belt velocity.

Example 27 may include the subject matter of any of Examples 25-26, and may further specify that the control circuitry includes at least one wireless sensor.

Example 28 may include the subject matter of any of Examples 24-27, and may further specify that the control circuitry is located in a housing of the user-paced treadmill.

Example 29 may include the subject matter of any of Examples 24-28, and may further specify that the control circuitry includes a communication pathway through an RJ-45 connector.

Example 30 is a method of controlling an equipment velocity of a piece of exercise equipment, including: determining, by control circuitry, a body velocity of a user of the piece of exercise equipment; determining, by the control circuitry, a leg swing velocity of the user; and changing the equipment velocity of the piece of exercise equipment, by the control circuitry, based at least in part on the body velocity and the leg swing velocity.

Example 31 may include the subject matter of Example 30, and may further specify that changing the equipment velocity includes: determining a change in the leg swing velocity of the user; summing the body velocity and the change in the leg swing velocity to generate an estimated user velocity; multiplying the estimated user velocity by an adjustment factor to generate an adjusted user velocity; and changing the equipment velocity by an amount equal to the adjusted user velocity divided by a sampling rate of the piece of exercise equipment.

Example 32 may include the subject matter of Example 31, and may further specify that the adjustment factor is a function of a position of the user on the piece of exercise equipment.

Example 33 may include the subject matter of any of Examples 30-32, and may further specify that changing the equipment velocity includes: generating an initial acceleration based at least in part on the body velocity and the leg swing velocity; comparing the initial acceleration to an acceleration threshold, wherein the acceleration threshold is a non-constant function of a current equipment velocity; determining that the initial acceleration exceeds the acceleration threshold for the current equipment velocity; and adjusting the equipment velocity in accordance with the acceleration threshold.

Example 34 is one or more non-transitory computer-readable media having instructions thereon that, in response to execution by one or more processing devices of control circuitry for a piece of exercise equipment, cause the control circuitry to: identify a current equipment velocity of the piece of exercise equipment; generate a new equipment velocity for the piece of exercise equipment based at least in part on a body velocity and a leg swing velocity of a user of the piece of exercise equipment; and cause the piece of exercise equipment to operate at the new equipment velocity.

Example 35 may include the subject matter of Example 34, and may further specify that cause the piece of exercise equipment to operate at the new equipment velocity includes communicate data indicative of the new equipment velocity, or a change from the current equipment velocity to the new equipment velocity, using a Communications Specification for Fitness Equipment (CSAFE) protocol.

Example 36 may include the subject matter of any of Examples 34-35, and may further specify that the one or more non-transitory computer-readable media is further to, in response to execution by the one or more processing devices, determine whether the user is running or walking, wherein determine the new equipment velocity for the piece of exercise equipment is based at least in part on whether the user is running or walking.

The invention claimed is:

1. A control apparatus for exercise equipment, comprising:

a sensor system to generate data representative of a user of the exercise equipment when the exercise equipment is operating at a first equipment velocity, wherein the sensor system includes a first sensor set to generate data representative of a body position of a user of the exercise equipment and a second sensor set, different from the first sensor set, to generate data representative of a leg position of the user, when the exercise equipment is operating at a first equipment velocity;

velocity generation circuitry to generate a second equipment velocity for the exercise equipment based at least in part on the body position and the leg position of the user by generating an increased equipment velocity, relative to the first equipment velocity, when the body position and the leg position of the user indicate a positive change in user velocity and by generating a decreased equipment velocity, relative to the first equipment velocity, when the body position and the leg position of the user indicate a negative change in user velocity; and velocity adjustment circuitry to cause the exercise equipment to operate at the second equipment velocity.

2. The control apparatus of claim 1, wherein generating a second equipment velocity for the exercise equipment includes determining a change in equipment velocity, wherein the second equipment velocity is equal to the first equipment velocity plus the change in equipment velocity.

3. The control apparatus of claim 1, wherein the velocity adjustment circuitry communicates the second equipment velocity, or a difference between the first equipment velocity and the second equipment velocity, to a processor that controls a motor of the exercise equipment.

4. The control apparatus of claim 3, wherein the control apparatus communicates with the processor using a Communications Specification for Fitness Equipment (CSAFE) protocol.

5. The control apparatus of claim 3, wherein the control apparatus communicates with the processor via an Ethernet cable.

6. The control apparatus of claim 3, wherein the velocity generation circuitry is located in a housing of the exercise equipment.

7. The control apparatus of claim 1, wherein the velocity adjustment circuitry provides electrical signals to a motor of the exercise equipment to cause the exercise equipment to operate at the second equipment velocity.

8. The control apparatus of claim 7, wherein the velocity generation circuitry is located in a housing of the exercise equipment.

9. The control apparatus of claim 1, wherein the velocity generation circuitry is secured to a handle of the exercise equipment.

10. The control apparatus of claim 1, wherein the exercise equipment is a treadmill.

11. The control apparatus of claim 1, wherein the exercise equipment includes a stepper motor or a DC motor.

12. The control apparatus of claim 1, wherein the sensor system includes a camera, a distance sensor, or an accelerometer.

13. The control apparatus of claim 12, wherein the sensor system includes at least one sensor to communicate wirelessly with the velocity generation circuitry.

14. A user-paced treadmill, comprising:

a belt;

a motor coupled to the belt; and control circuitry, communicatively coupled to the motor, to adjust a belt velocity based at least in part on a body position and a leg position of a user of the user-paced treadmill by increasing the belt velocity when the body position and the leg position of the user indicate a positive change in user velocity and by decreasing the belt velocity when the body position and the leg position of the user indicate a negative change in user velocity, wherein the control circuitry includes a sensor system to generate data representative of the user, the sensor system includes a first sensor set to generate data representative of the body position of the user, and the sensor system includes a second sensor set, different from the first sensor set, to generate data representative of the leg position of the user.

15. The user-paced treadmill of claim 14, wherein the control circuitry includes at least one wireless sensor.

16. The user-paced treadmill of claim 14, wherein the control circuitry is located in a housing of the user-paced treadmill.

17. The user-paced treadmill of claim 14, wherein the control circuitry includes a communication pathway through an RJ-45 connector.

18. One or more non-transitory computer-readable media having instructions thereon that, in response to execution by one or more processing devices of control circuitry for a piece of exercise equipment, cause the control circuitry to:

identify a current equipment velocity of the piece of exercise equipment;

generate a new equipment velocity for the piece of exercise equipment based at least in part on a body position and a leg position of a user of the piece of exercise equipment by generating an increased equipment velocity, relative to the current equipment velocity, when the body position and the leg position of the user indicate a positive change in user velocity and by generating a decreased equipment velocity, relative to the current equipment velocity, when the body position and the leg position of the user indicate a negative change in user velocity, wherein the control circuitry includes a sensor system to generate data representative of the user, the sensor system includes a first sensor set to generate data representative of the body position of the user, and the sensor system includes a second sensor set, different from the first sensor set, to generate data representative of the leg position of the user; and cause the piece of exercise equipment to operate at the new equipment velocity.

19. The one or more non-transitory computer-readable media of claim 18, wherein causing the piece of exercise equipment to operate at the new equipment velocity includes communicating data indicative of the new equipment velocity, or a change from the current equipment velocity to the new equipment velocity, using a Communications Specification for Fitness Equipment (CSAFE) protocol.

* * * * *